US007934297B2

(12) United States Patent
Williams et al.

(10) Patent No.: US 7,934,297 B2
(45) Date of Patent: May 3, 2011

(54) TWIST OFF TAMPER-PROOF FASTENER

(76) Inventors: Mark Kent Williams, Colbert, WA (US); David Joe Williams, Colbert, WA (US); Kenneth Garnet Fry, Spokane, WA (US)

( * ) Notice: Subject to any disclaimer, the term of this patent is extended or adjusted under 35 U.S.C. 154(b) by 0 days.

(21) Appl. No.: 12/284,258

(22) Filed: Sep. 22, 2008

(65) Prior Publication Data

US 2010/0071169 A1 Mar. 25, 2010

(51) Int. Cl.
*B65D 63/10* (2006.01)

(52) U.S. Cl. ..... 24/16 PB; 292/307 A

(58) Field of Classification Search ..... 24/16 PB, 24/17 AP, 16 R, 17 A, 31.5 R, 30.5 P; 248/74.3; 292/318, 321, 325, 307 A
See application file for complete search history.

(56) References Cited

U.S. PATENT DOCUMENTS

| | | | | |
|---|---|---|---|---|
| 3,416,198 | A | 12/1968 | Geisinger | |
| 3,556,575 | A | 1/1971 | Farkas | |
| 4,001,919 | A | 1/1977 | Moberg et al. | |
| 4,214,349 | A | 7/1980 | Munch | |
| 4,501,049 | A | 2/1985 | Adamson | |
| 4,532,679 | A * | 8/1985 | Scott | 24/16 PB |
| 4,537,432 | A | 8/1985 | Meeks | |
| 4,754,529 | A * | 7/1988 | Paradis | 24/16 PB |
| 5,146,654 | A | 9/1992 | Caveney et al. | |
| 5,389,330 | A * | 2/1995 | Sorensen et al. | 264/328.1 |
| 5,470,520 | A * | 11/1995 | Sorensen et al. | 264/297.2 |
| 5,524,945 | A | 6/1996 | Georgopoulos et al. | |
| 5,636,412 | A * | 6/1997 | Lodi et al. | 24/16 PB |
| 5,911,368 | A * | 6/1999 | Davignon | 24/16 PB |
| 5,956,814 | A * | 9/1999 | Choi | 24/16 PB |
| 6,044,524 | A * | 4/2000 | Sorensen et al. | 24/16 PB |
| 6,185,792 | B1 * | 2/2001 | Nelson et al. | 24/16 PB |
| 6,347,435 | B1 | 2/2002 | Davignon et al. | |
| 6,449,808 | B1 | 9/2002 | Zappa et al. | |
| 6,789,341 | B1 | 9/2004 | Badura | |
| 7,017,237 | B2 * | 3/2006 | Magno et al. | 24/16 PB |
| 7,052,055 | B1 | 5/2006 | Castro | |
| 7,127,779 | B2 * | 10/2006 | Hewes | 24/16 PB |
| 7,740,210 | B2 * | 6/2010 | Pilon et al. | 248/74.3 |
| 2002/0152589 | A1 | 10/2002 | Wada et al. | |

* cited by examiner

*Primary Examiner* — Robert J Sandy
*Assistant Examiner* — Rowland D Do
(74) *Attorney, Agent, or Firm* — William A. Jeckle; Keith S. Bergman

(57) ABSTRACT

A twist off tamper-proof fastener having an elongate flexible strap defining a plurality of parallel adjacent transverse teeth in opposing planar surfaces. First end portion of elongate strap is tapered to a rounded tip for insertion through a "T" slot defined in a dimensionally larger head portion carried at opposing end of the elongate strap. A fixed tooth and plural angulated teeth carried by a flexing arm irremovably engage with the teeth defined in the elongate strap. The head portion is elliptic with opposing spaced apart rounded ends and opposing planar sides to facilitate grasping and twisting by a user, and for identifying indicia. A circumferentially extending notch is defined in the elongate strap immediately adjacent the head portion. Twisting the head portion creates shearing forces that are focused at the circumferential notch breaking the fastener and allowing removal without tools.

16 Claims, 3 Drawing Sheets

10
11
15
17
18
19
20
23
24
25
26
27
30
31
32
33
34
35
36
37
40
41
42
43
44
46

FIG. 6
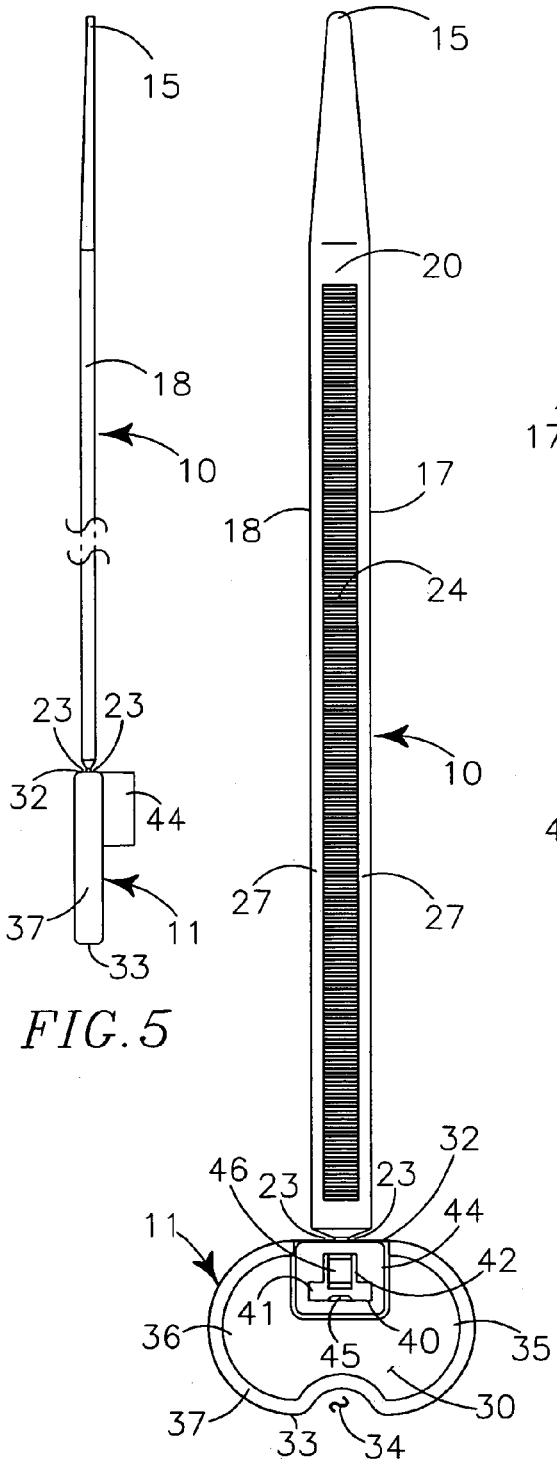
FIG. 5
FIG. 7
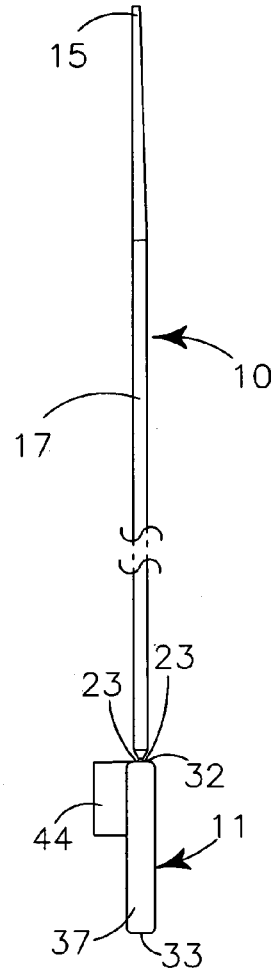
FIG. 8
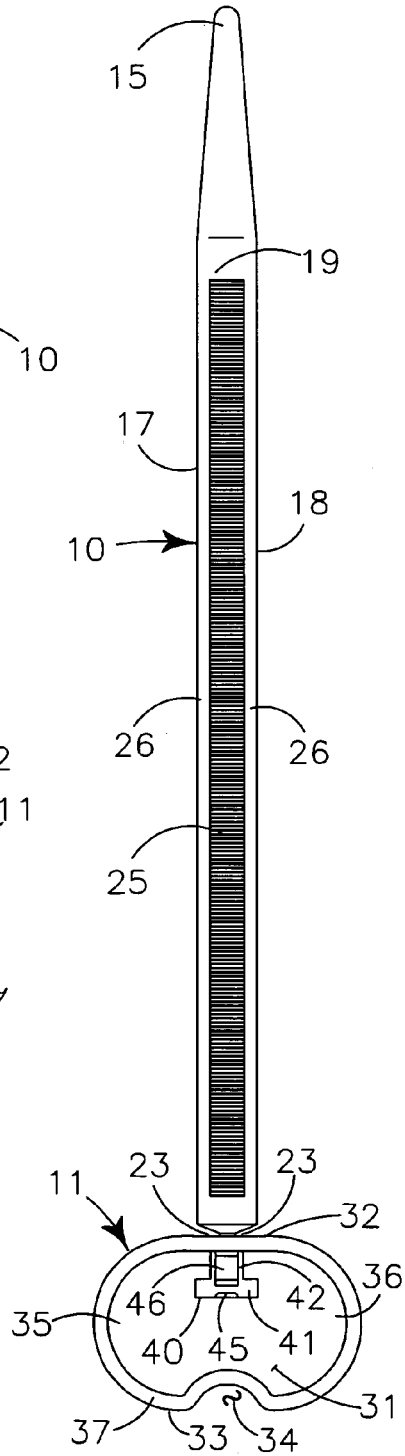

FIG. 9
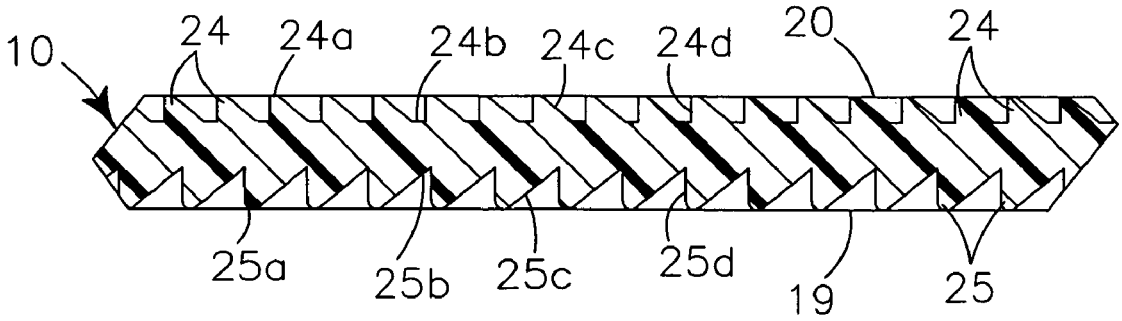
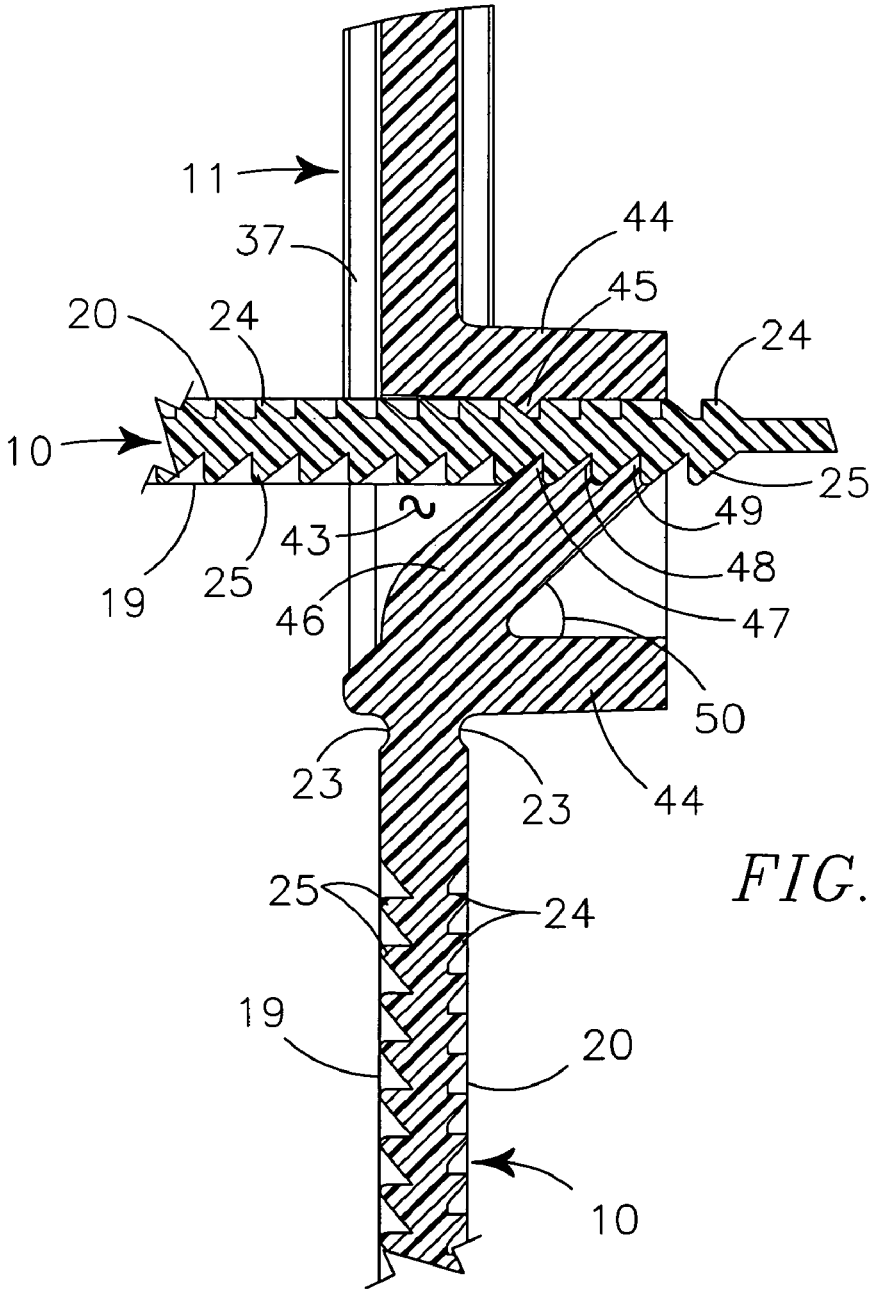
FIG. 10

TWIST OFF TAMPER-PROOF FASTENER

RELATED APPLICATIONS

There are no other patent applications related hereto heretofore filed in the United States of America or in any other country.

BACKGROUND OF INVENTION

1. Field of Invention

This invention relates to clasps and closures and more particularly to single use fasteners having a head portion defining a slot at one end of an elongate strap that loops over and irremovably engages in the slot.

2. Background and Description of Prior Art

Fasteners of the instant type are commonly referred to as "cable ties" and are well-known for fastening items together such as container latches, bundles of wire and groupings of flexible tubular members. Typically the fastener is threaded through adjacent aligned holes defined in portions of a container that move distally from one another when the container is opened, or the fastener is extended circumferentially around the bundle of wires/groupings of hose to secure the wires/hoses in proximity to one another.

Generally, cable ties have an elongate strap that is tapered at one end portion. Opposite the tapered end portion is a dimensionally larger head portion defining a slot through which the tapered end portion of the elongate strap may be inserted. A resiliently displaceable pawl is carried within the slot and the pawl engages with one of a plurality of parallel adjacent transverse grooves defined in the elongate strap.

Cable tie type fasteners are typically single use items. Once the elongate strap is inserted through the slot and the pawl has engaged with the parallel transverse grooves, the elongate strap cannot be withdrawn from the slot without breaking the pawl, breaking the elongate strap or otherwise physically destroying the cable tie. Once the cable tie has been broken, it cannot be repaired or re-affixed.

The inability to remove a fastened cable tie without physically or functionally destroying the cable tie is both a desirable feature and a drawback.

Because of their single use nature, cable ties are commonly used in apparatus that require security, such as the transport of money, pharmaceuticals and other valuable commodities. When a container of the commodity is filled, closed and thereafter secured with a cable tie, it can reasonably be assumed that if the container, and in-place cable tie, are undisturbed when the container is later opened, and that the container and contents have not been tampered with. Conversely, if the container or the cable tie have been broken, it can reasonably be assumed that the original contents of the container have been tampered with and are no longer in the condition and perhaps quantity, as they were when the cable tie was originally secured to the container.

In the pharmaceutical industry, cable ties are used to securely close pharmaceutical tote boxes. A tote box arriving with the cable tie broken or damaged can be rejected or at a minimum closely inspected.

By the same token, one of the drawbacks of cable ties is that they are difficult to break. Cutting the cable tie with a wire cutter or knife poses a risk of unintentionally damaging the item being secured and requires use of a tool. Breaking the cable tie by inserting an elongate rigid object, such as a screwdriver, through the looped elongate strap and twisting the object to break the cable tie is even more likely to damage the item secured by the cable tie.

There are known "tear away" cable ties designed for easy removal. Tear away cable ties have a planar rectilinear tag adjacent the head portion and define a "scored" or "weakened" area between the tag and the head portion. Pulling on the rectilinear tag portion tears the cable tie at the "scored/weakened" area detaching the head portion from the strap portion without use of a tool or cutting device. Unfortunately, shearing forces such as those used to intentionally break known "tear away" cable ties may be inadvertently applied to the cable tie if the rectilinear tag is inadvertently caught between two surfaces that move relative to one another, such as a top and a bottom or adjacent sides of adjacent containers being transported in a vehicle. Any movement wherein one container moves along and across an adjacent container provides the necessary action to break known tear away cable ties. Further, known "tear away" cable ties with rectilinear tags have sharp edges and corners, they are not aesthetically pleasing, they are difficult to package in bundles because the rectilinear tags "catch" on one another and they can be difficult to manufacturer.

What is needed is a durable secure and tamper-proof cable tie type fastener that cannot be removed without destroying the cable tie, but can be intentionally removed without resorting to tools and without damaging the item being secured. The cable tie must be easy to use, not subject to unintentional breakage, aesthetically pleasing, easy to manufacture and package and must be able to be marked with unique identifying indicia.

Our twist off tamper-proof fastener addresses various of these drawbacks by providing a product that is strong and secure and is less likely to be inadvertently and unintentionally broken, but can also be broken without use of tools when desired. When broken, the fact the cable tie has been broken is un-mistakenly identifiable.

Our invention is an improved cable tie type fastener comprising an elongate strap of flexible yet strong plastic, preferably polypropylene, that defines a plurality of parallel adjacent transverse teeth in opposing planar surfaces. One end portion of the elongate strap is tapered to a rounded tip to ease insertion through a "T" slot defined in a head portion integrally carried at the end of the elongate strap opposite the tapered tip.

The "T" slot carries a fixed fingernail tooth and an opposing flexing arm having plural angular teeth that cooperatively engage with the transverse teeth defined in the elongate strap. The fingernail tooth and angulated teeth are configured to prevent the elongate strap from being withdrawn from the "T" slot once inserted therethrough and a peripheral frame around the "T" slot prevents insertion of tools that might be used to tamper with the flexing arm.

The head portion is elliptic having opposing spaced apart rounded end portions and opposing planar sides that can be marked with unique identification indicia, bar codes, trademarks and the like with lasers, ink jet printers and other known marking means to identify a particular cable tie, order or container to which the cable tie is affixed.

A circumferentially extending notch is formed in the elongate strap immediately adjacent the head portion. The notch does not negatively affect the axial or tensile strength of the cable tie.

The elliptic configuration of the head portion facilitates grasping and twisting of the head portion by a user. The twisting action focuses shearing forces on the elongate strap immediately below the head portion at the circumferentially extending notch. The twisting action breaks the cable tie at the circumferentially extending notch allowing the cable tie's removal without tools and without damaging the item to which the cable tie was fastened.

SUMMARY

A twist-off tamper-proof fastener having an elongate flexible strap defining a plurality of parallel adjacent transverse teeth in opposing planar surfaces. First end portion of elongate strap is tapered to a rounded tip for insertion through a "T" slot defined in a head portion carried at opposing end of the elongate strap. A fixed tooth and plural angulated teeth carried by a flexing arm irremovably engage with the teeth defined in the elongate strap. The head portion is elliptic with opposing spaced apart rounded ends and opposing planar sides to facilitate grasping and twisting by a user, and for identifying indicia. A circumferentially extending notch is defined in the elongate strap immediately adjacent the head portion. Twisting the head portion focuses shearing forces at the circumferential notch breaking the cable tie and allowing removal without tools.

In providing such an apparatus it is:

a principal object to provide a twist off tamper-proof fastener that is irremovable without breaking.

a further object to provide a twist off tamper-proof fastener that is a secure fastener.

a further object to provide such a twist off tamper-proof fastener having a head portion with opposing planar surfaces that can be permanently marked with identifying indicia.

a further object to provide a twist off tamper-proof fastener that can be broken without a tool.

a further object to provide a twist off tamper-proof fastener having a circumferentially extending notch defined in the elongate strap immediately adjacent the head portion.

a further object to provide a twist off tamper-proof fastener defining a "T" slot in the head portion in which the elongate strap is secured.

a further object to provide a twist off tamper-proof fastener having a peripheral frame around the "T" slot that prevents tampering with the arm.

a further object to provide a twist off tamper-proof fastener defining a plurality of parallel adjacent transverse teeth in opposing surfaces of the elongate strap.

a further object to provide a twist off tamper-proof fastener having a head portion configured for grasping and twisting.

a further object to provide a twist off tamper-proof fastener having a configuration that concentrates shearing forces at a predefined location.

a further object to provide a twist off tamper-proof fastener that breaks at the circumferentially extending notch when a twisting shearing force is applied to the head portion.

a further object to provide a twist off tamper-proof fastener having a head portion with opposing planar surfaces that may be marked with unique identifying indicia such as with a laser.

a further object to provide a twist off tamper-proof fastener having plural angulated teeth on a flexing arm.

a further object to provide a twist off tamper-proof fastener that is tamper resistant.

a further object to provide a twist off tamper-proof fastener having an immovable fingernail tooth and opposing spaced apart angulated teeth on a flexing arm inside the "T" slot.

a further object to provide a twist off tamper-proof fastener having a plurality of first size parallel adjacent transverse teeth on first surface of the elongate strap, and a plurality of second size parallel adjacent transverse teeth on second opposing surface of the elongate strap.

a further object to provide a twist off tamper-proof fastener of polypropylene having a dye that can be evaporated when subjected to a laser beam creating a unique identifier on the twist off tamper-proof fastener.

a still further object to provide a twist off tamper-proof fastener that is of new and novel design, of rugged and durable nature, of simple and economic manufacture and one that is otherwise well suited to the uses and purposes for which it is intended.

Other and further objects of our invention will appear from the following specification and accompanying drawings which form a part hereof. In carrying out the objects of our invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

FIG. 5 is a partial orthographic second side view of our twist off tamper-proof fastener.

FIG. 6 is an orthographic bottom view of our twist off tamper-proof fastener.

FIG. 7 is a partial orthographic first side view of our twist off tamper-proof fastener.

FIG. 8 is an orthographic top view of our twist off tamper-proof fastener.

FIG. 9 is an enlarged orthographic cross-section view of a portion of the elongate strap showing the fine transverse teeth and the coarse transverse teeth.

FIG. 10 is an enlarged orthographic cross-section view of the head portion and "T" slot showing the fingernail tooth and plural angulated teeth of the flexing arm engaged with the transverse fine and coarse teeth of the elongate strap inserted through the "T" slot.

DESCRIPTION OF PREFERRED EMBODIMENT

Figures 1, 2, 3, 4:
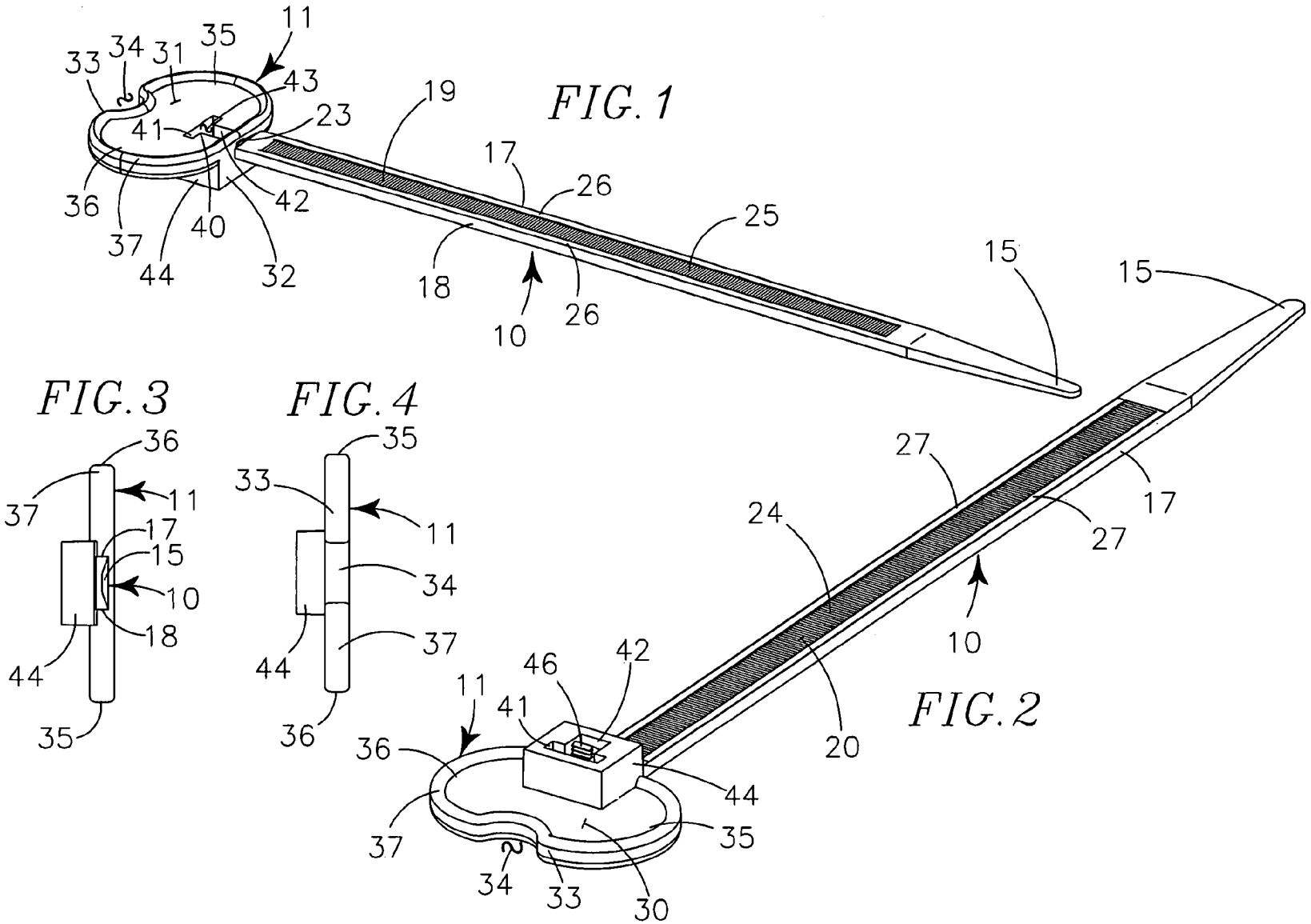
FIG. 1 is an isometric top and side view of our twist off tamper-proof fastener viewed from the rounded tip portion toward the head portion.
FIG. 2 is an isometric bottom and side view of our twist off tamper-proof fastener viewed from the head portion toward the rounded tip portion.
FIG. 3 is an orthographic end the view of our twist off tamper-proof fastener viewed from the rounded tip portion toward the head portion.
FIG. 4 is an orthographic end view of our twist off tamper-proof fastener viewed from the head portion toward the rounded tip portion.

A twist off tamper-proof fastener generally provides an elongate strap 10 having a head portion 11 defining "T" slot 40. The elongate strap 10 and head portion 11 are preferably formed of polypropylene, but may also be formed of nylon, polyethylene and other flexible resiliently deformable plastics.

The elongate strap 10 carries the head portion 11 at one end and is tapered to a rounded tip 15 at the opposing end portion to ease insertion through the "T" slot 40. The elongate strap 10 has a first side 19 and an opposing second side 20 defined by first elongate edge portion 17 and second elongate edge portion 18.

A plurality of parallel adjacent coarse teeth 25 are defined in the first side 19 and extend transversely partially across the first side 19 from a position spaced apart from the first elongate edge portion 17 to a position spaced apart from the second elongate edge portion 18, leaving border 26 adjacent the first elongate edge 17 and second elongate edge 18 without coarse teeth 25. The coarse teeth 25 are defined in the first side 19 from a position spaced apart from the rounded tip 15 to a position spaced apart from the head portion 11.

A plurality of parallel adjacent fine teeth 24 are defined in the second side 20 and extend transversely partially across the second side 20 from a position spaced apart from the first elongate edge portion 17 to a position spaced apart from the second elongate edge portion 18, leaving border 27 adjacent the first elongate edge 17 and second elongate edge 18 without fine teeth 24. The fine teeth 24 are defined in the second side 20 from a position spaced apart from the rounded tip 15 to a position spaced apart from the head portion 11.

As shown in FIG. 9, each coarse tooth 25 and each fine tooth 24 has a crest 25*a*, 24*a* a trough 25*b*, 24*b*, a ramp portion 25*c*, 24*c* and a relief 25*d*, 24*d* and collectively form a plurality of teeth 25, 24 along the elongate strap 10 that may easily pass, only in one direction, through the "T" slot 40 between the fingernail tooth 45 and the flexing arm 46. The coarse teeth 25 are dimensionally larger than the fine teeth 24 which cause the coarse teeth 24 and the fine teeth 25 to be offset from one another along the elongate strap 10.

The head portion 11 is elliptic in shape having a first wing 35 at one lateral edge, a second wing 36 at the opposing lateral edge, a first marking side 30 and an opposing second marking side 31. The elongate strap 10 is interconnected with the head portion 11 at perimeter edge 37 between the wings 35, 36. A circumferentially extending notch 23 extends about the elongate strap 10 immediately adjacent the head portion 11 creating a localized area having reduced resistance to shearing forces.

A concave notch 34 is defined in the head portion 11 perimeter edge 34 opposite the elongate strap 10. The first marking side 30 and the second marking side 31 are generally planar to accommodate unique marking indicia, such as barcodes, numbers, trademarks and the like that may be imprinted on the marking sides 30, 31 with devices such as lasers, inkjet printing, silk-screening, and the like.

"T" slot frame 44 is carried by the head portion 11 adjacent the perimeter edge 34 and proximate the circumferentially extending notch 23 and elongate strap 10. The "T" slot frame 44 is generally rectilinear and protrudes perpendicularly from the first marking side 30. The "T" slot frame 44 defines the "T" slot 40 which has a parallel portion 42 aligned with the elongate strap 10, and a transverse portion 41 that communicates with the parallel portion 42 opposite the elongate strap 10. The "T" slot 40 defines a through channel 43 into which the rounded tip portion 15 of the elongate strap 10 may be inserted. The side-to-side dimension of the transverse portion 41 is greater than the side-to-side dimension of the parallel portion 42 and is only slightly greater than the distance between the first elongate edge 17 and the second elongate edge 18. The transverse portion 41 of the "T" slot 40 carries an immovable fingernail tooth 45 inside the channel 43 opposite the parallel portion 42 that is sized and configured to engage with the fine teeth 24 defined in the second side 20 of the elongate strap 10.

The parallel portion 42 carries flexing arm 46 that is anchored within the parallel portion 42 proximate the circumferentially extending notch 23. As shown in FIG. 9, the flexing arm 46 is angulated into channel 43 and away from the second marking side 31 at the angle 50 which is established in the manufacturing process. Angle 50 pre-loads the flexing arm 46 to enhance direct frictional engagement with the coarse teeth 25 defined in the elongate strap 10 when the flexing arm 46 is deflected by the elongate arm 10 being inserted through the "T" slot 40 and simultaneously positionally biases the elongate strap 10 into continuous direct frictional engagement with the fingernail tooth 45. Angle 50 is preferably greater than 40 degrees and less than 52 degrees and is optimally 45.09 degrees.

End portion of the flexing arm 46, proximate the transverse portion 41 defines a first arm tooth 47, an adjacent parallel second arm tooth 48 and an adjacent parallel third arm tooth 49. The arm teeth 47, 48, 49 are sized and configured to securely engage with the coarse teeth 25 defined in the first side 19 of the elongate strap 10. The side-to-side dimension of the flexing arm 46 and teeth 47, 48, 49 carried thereby is equal to the side-to-side dimension of the coarse teeth 25 defined in the first side 19 of the elongate strap 10. The borders 26, 27 of the elongate strap 10 slide through the "T" notch 40 in those areas of the transverse portion 41 that are laterally outward of the parallel portion 42 edges, and increase the rigidity of the engagement of the elongate strap 10 and the "T" slot 40 with fingernail tooth 45 and teeth 47, 48, 49 of the flexing arm 46 to further reduce the likelihood of successful tampering.

The elliptic configuration of the head portion 11 including the opposing spaced apart wings 35, 36 facilitates grasping and twisting of the head portion 11 by a user. The twisting action focuses shearing forces on the elongate strap 10 immediately adjacent the head portion 11 at the circumferentially extending notch 23. The twisting action shears the cable tie at the circumferentially extending notch 23 allowing breakage without tools and without damaging any item the cable tie might be securing.

Having described the structure of our twist off tamper-proof fastener, its operation may be understood.

The twist off tamper-proof fastener is placed proximate an item to be secured, such as a tote box (not shown) containing valuable pharmaceuticals. The rounded tip portion 15 of the elongate strap 10 is inserted through a closing latch (not shown) of a tote box (not shown). The rounded tip portion 15 is looped over and inserted into the transverse portion 41 of the "T" slot 40 entering from the second marking side 31 and exiting the first marking side 30.

The rounded tip portion 15 is grasped by the user, and drawn through the "T" slot 40 so that some portion of the elongate strap 10 defining teeth 24, 25 passes through the "T" slot 40. As the elongate strap 10 passes through the "T" slot 40, the fingernail tooth 45 engages with the fine teeth 24 defined in the second side 20 the elongate strap 10, and the first, second and third teeth 47, 48, 49 respectively of the flexing arm 46 engage with the coarse teeth 25 defined in the first side 19 of the elongate strap. The angulation 50 of the flexing arm 46 relative to the elongate strap 10, and the resiliency of the material forming the cable tie allows the flexing arm 46 to bend toward the first marking side 30 effectively allowing the crests 24*a*, 25*a* of the fine teeth 24 and coarse teeth 25 to pass over the fingernail tooth 45 and flexing arm teeth 47, 48, 49 until the elongate strap 10 is snug about the item being secured.

The retentive memory of the flexing arm 46 causes the first 47, second 48 and third 49 teeth to engage with the coarse teeth 25 defined in the first side 19 of the elongate strap 10 when the elongate strap 10 is no longer being drawn through the "T" slot 40 from the second marking side 31 toward the first marking side 30. If the user attempts to draw the elongate strap 10 from the "T" slot 40 in the reverse direction, the angulation of the finger nail tooth 45 and the flexing arm teeth 47, 48, 49 and the interlocking elongate strap teeth 24, 25 prevent the withdrawal of the elongate strap 10 from the "T" slot 40.

To remove the fastener, the user grasps the head portion 11 and twists the head portion 11 axially about the elongate strap 10. The twisting of the head portion 11 focuses shearing forces at the circumferential notch 23 at the interconnection of the elongate strap 10 and head portion 11. The preferred polypropylene material of the cable tie is resistant to tensile forces, but is less resistant to shearing forces. The shearing force applied by the twisting of the head portion 11 causes the tamper-proof fastener to break at the circumferentially extending notch 23 allowing the cable tie's removal. Once the fastener has been broken, it cannot be reaffixed without displaying physical evidence of the breakage. If a unique identifier, such as a barcode has been imprinted on one of the marking sides 30, 31 persons receiving the container with a different unique identifier should be able to identify that the container has been opened and can take the necessary actions such as inventorying the contents of the container.

The foregoing description of our invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described our invention, what we desire to protect by Letters Patent, and

What we claim is:

1. A twist off tamper-proof fastener that requires destruction for removal, comprising in combination:

an elongate strap having a first side portion, an opposing second side portion and tapered to a rounded tip at one end portion;

plural parallel adjacent transverse teeth defined in the first side portion and in the second side portion;

a head portion interconnected with the elongate strap opposite the rounded tip, the head portion having, a rigid substantially planar configuration with a first wing at one lateral edge and a spaced apart second wing at opposing lateral edge, the first wing and the second wing defining a first planar marking side and an opposing second planar marking side for marking indicia, a T slot frame to prevent tampering between the first wing and the second wing defining a T slot channel therethrough communicating from the first planar marking side to the opposing second planar marking side proximate the interconnection with the elongate strap, the T slot channel having, a parallel portion spacedly adjacent and aligned with the elongate strap communicating with a transverse portion distal from the elongate strap, the transverse portion having dimensions substantially similar to dimensions of the elongate strap to allow the elongate strap to pass therethrough and to positionally secure the elongate strap within the transverse portion of the T slot channel to reduce likelihood of tampering, an immovable fingernail tooth within the transverse portion opposite the parallel portion for engagement with transverse teeth defined in one side portion of the elongate strap, a flexing arm within the parallel portion having at least one tooth on an end portion proximate the fingernail tooth for engagement with transverse teeth defined in the opposing side portion of the elongate strap;

a notch defined in and extending circumferentially about the elongate strap immediately adjacent the head portion that creates reduced resistance to shearing forces but is resistant to tensive forces;

the rounded tip and a length of the elongate strap may pass through the transverse portion of the T slot channel in only one direction and not removed therefrom;

the twist off fastener must be destroyed to be removed; and the fastener is breakable without tools by a user manually grasping and twisting the head portion using the first and second wings for leverage which focuses shearing forces at the circumferentially extending notch causing the fastener to break at the circumferentially extending notch.

2. The fastener of claim 1 wherein the head portion is elliptic in shape.

3. The fastener of claim 1 further comprising:

plural arm teeth on the flexing arm end portion proximate the fingernail tooth for simultaneous engagement with the plural transverse teeth defined in one side portion of the elongate strap.

4. The fastener of claim 1 wherein:

the plural parallel transverse teeth defined in first side portion of the elongate strap are a first size and the plural parallel transverse teeth defined in the second side portion of the elongate strap are a second size.

5. The fastener of claim 4 wherein:

the fingernail tooth within the transverse portion of the T slot channel is sized and configured to cooperatively engage with at least one of the plural parallel transverse teeth defined in first side portion of the elongate strap, and the at least one flexing arm tooth is sized and configured to cooperatively engage with at least one of the plural parallel transverse teeth defined in opposing second side portion of the elongate strap.

6. The fastener of claim 1 wherein:

the material comprising the fastener is nylon.

7. The fastener of claim 1 wherein:

the material comprising the fastener is polypropylene.

8. The fastener of claim 1 wherein:

the material comprising the fastener is polyethylene.

9. The fastener of claim 1 wherein:

the material comprising the fastener is a thermal plastic.

10. The fastener of claim 1 wherein:

the material comprising the fastener is a flexible resiliently deformable plastic.

11. The fastener of claim 1 wherein:

the circumferentially extending groove defined in the elongate strap adjacent the head portion is concave.

12. The fastener of claim 1 wherein:

the circumferentially extending notch defined in the elongate strap adjacent the head portion has a vertex.

13. The fastener of claim 1 wherein:

twisting the head portion focuses shearing forces at the circumferentially extending notch defined in the elongate strap causing the fastener to break at the circumferentially extending notch.

14. The fastener of claim 1 wherein:

the first and second marking sides of the head portion may be marked with identifying indicia.

15. The fastener of claim 1 wherein:

an angle of the flexing arm positionally biases the at least one flexing arm tooth into engagement with at least one of the plural parallel transverse teeth defined in one side of the elongate strap and simultaneously causes the fingernail tooth to engage with at least one of the plural parallel transverse teeth defined in opposing side of the elongate strap.

16. The fastener of claim 1 wherein:

an angle of the flexing arm is greater than 40 degrees and less than 52 degrees.

* * * * *